United States Patent [19]

LeBreton

[11] 4,330,236

[45] May 18, 1982

[54] SYSTEM FOR KEYING DISCS TO A SHAFT

[75] Inventor: Albert F. LeBreton, Middletown, Pa.

[73] Assignee: Westinghouse Electric Corp., Pittsburgh, Pa.

[21] Appl. No.: 135,036

[22] Filed: Mar. 28, 1980

[51] Int. Cl.[3] ..... F01D 5/06

[52] U.S. Cl. ..... 416/198 A; 416/199; 416/244 A

[58] Field of Search ..... 416/198 R, 198 A, 200 A, 416/201 R, 201 A, 244 A, 199

[56] References Cited

U.S. PATENT DOCUMENTS

| | | | |
|---|---|---|---|
| 1,593,393 | 7/1926 | Doran | 416/198 A |
| 1,873,956 | 8/1932 | Dahlstrand | 416/198 A X |
| 2,832,565 | 4/1958 | Thomas et al. | 416/198 A X |
| 3,304,052 | 2/1967 | Warner et al. | 416/198 A |
| 3,822,953 | 7/1974 | Adelizzi | 416/244 A X |
| 4,242,008 | 12/1980 | Bernasconi | 416/244 A X |
| 4,247,256 | 1/1981 | Maghon | 416/244 A X |

FOREIGN PATENT DOCUMENTS

| | | | |
|---|---|---|---|
| 648174 | 12/1928 | France | 416/244 A |
| 376136 | 10/1939 | Italy | 416/244 A |

*Primary Examiner*—Everette A. Powell, Jr.
*Attorney, Agent, or Firm*—F. J. Baehr, Jr.

[57] ABSTRACT

A face disc keyed to the shaft and keyed to a peripheral flange on a turbine blade disc eliminates stress concentration at the highly stressed juncture of the blade disc and shaft on fabricated turbine rotors.

5 Claims, 3 Drawing Figures

SYSTEM FOR KEYING DISCS TO A SHAFT

BACKGROUND OF THE INVENTION

This invention relates to a system for keying discs to a shaft and more particularly to a system for keying blade discs to a shaft in a steam turbine.

In large steam turbines the last stages of the turbine become extremely large with blades in the neighborhood of eight feet long extending from a spindle which is approximately four feet in diameter. Therefore, it is desirable to fabricate the spindle utilizing a relatively small diameter shaft with discs shrunk onto the shaft. Even though the discs are shrunk on the shaft with an interference fit, because of differential heating and the large torque transmitted between the discs and the shaft it has been common practice to key the discs to the shaft. The keys had a rectangular cross-section with relatively sharp corners, which resulted in very high stress concentrations at the corners and after many hours of operation cracks began to form radiating from the corners of the keyways. To reduce the concentration of stresses in the keyways round keys were used and round holes were drilled at the juncture of the discs and shaft as this eliminated the sharp corners in the rectangular keyways and reduced the stress concentration; however, the area adjacent the bore of the discs have very large stresses, the round keys did produce stress concentration, and have resulted in cracking eminating from the round keyways. Therefore, an object of this invention is to eliminate any type of stress concentration in the bore of the discs and prevent relative movement between the discs and the shaft during periods of differential heating.

SUMMARY OF THE INVENTION

In general, a rotor for a fluid machine, when made in accordance with this invention, comprises a shaft having a plurality of circumferential steps which ascend from at least one end thereof, a plurality of blade discs each having a bore which fits a particular circumferential step, a plurality of face discs each having a bore which fits a particular circumferential step. Each face discs has a skirt adjacent its outer periphery which fits over a portion of a particular blade disc. There are a plurality of keys disposed at the juncture of the circumferential steps and the bore of the face discs. The circumferential steps and face disc bores have aligned grooves which form openings for receiving these keys. There are a plurality of keys disposed at the juncture of the skirts and the portion of the blade discs. The skirts and portions of the blade disc have alignment grooves which form openings for receiving these keys.

BRIEF DESCRIPTION OF THE DRAWINGS

The objects and advantages of this invention will become more apparent from reading the following detailed description in conjunction with the accompanying drawings, in which.

DESCRIPTION OF THE PREFERRED EMBODIMENT

Figure 1:
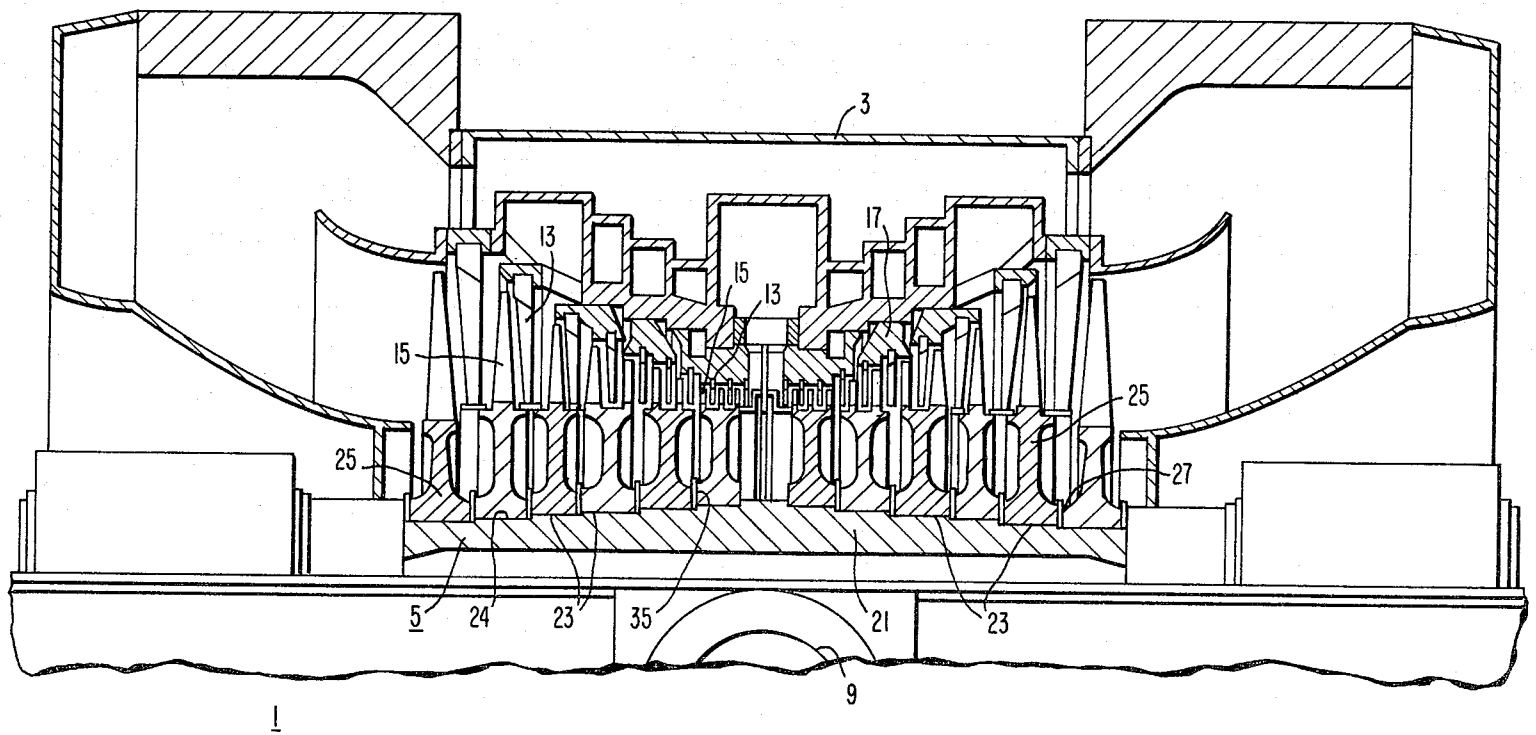
FIG. 1 is a partial sectional view of a turbine and rotor incorporating this invention.
Figure 3:
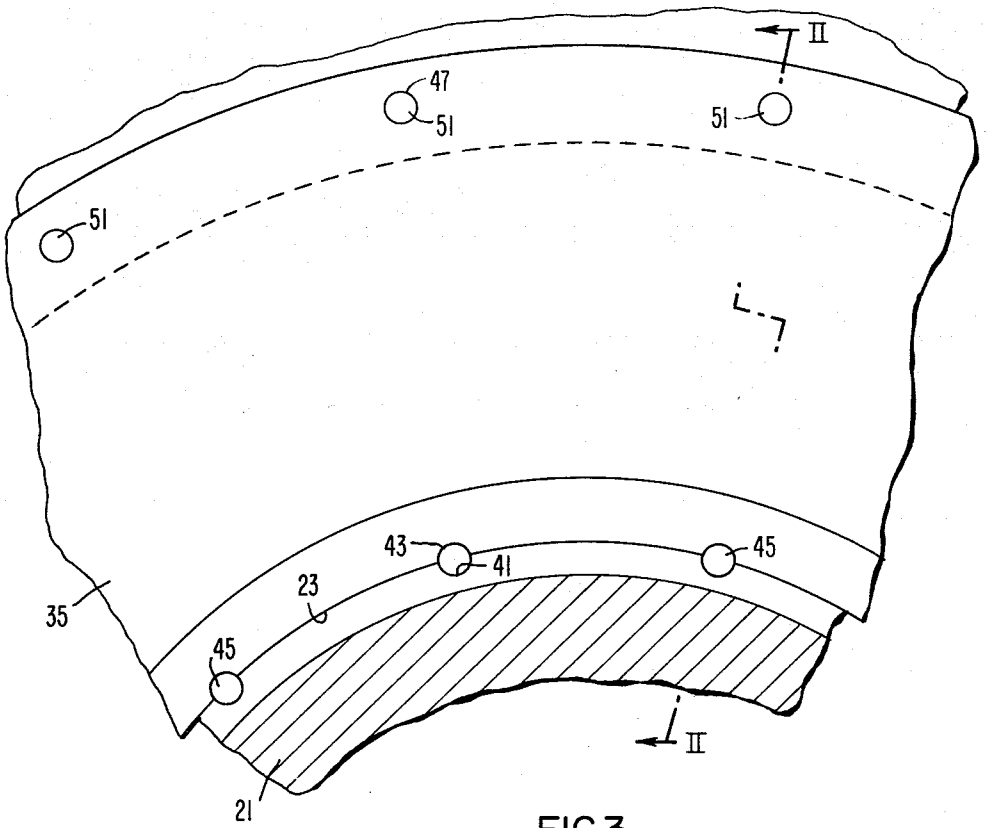
FIG. 3 is a partial sectional view taken on line III—III of FIG. 2.

Referring now to the drawings in detail and in particular to FIG. 1 there is shown a low pressure steam turbine or fluid machine 1 which comprises an enclosed housing or casing 3 with a rotor 5 disposed therein. The casing 3 has journal bearings 7 disposed on opposite ends thereof for rotatably supporting the rotor 5. A steam inlet nozzle 9 is disposed in the central portion of the casing 3 to supply steam to circular arrays of stationary and rotatable blades 13 and 15, respectively, affixed to the casing 3 and rotor 5. The stationary blades 13 are disposed in blade rings or diaphragms 17 which attach to the casing 3 producing pressure stages as the steam expands through the turbine 1. The casing 3, journal bearings 7, and blade diaphragms 17 are split horizontally so that the upper half of the casing may be removed to permit the removal of the rotor 5.

The rotor 5 comprises a shaft 21 having a plurality of circumferential steps 23 which ascend from each end thereof. Disposed on the circumferential steps 23 are blade discs 25 which have a central hub 27 and one or more circular array of rotatable blades 15 attached to their outer periphery. The hubs 27 each have a central bore 29 sized to fit a particular or mating step 23 on the shaft 21. The bore 29 is normally slightly smaller than the diameter of the mating step over which it slides producing interference or shrink fit therebetween.

Figure 2:
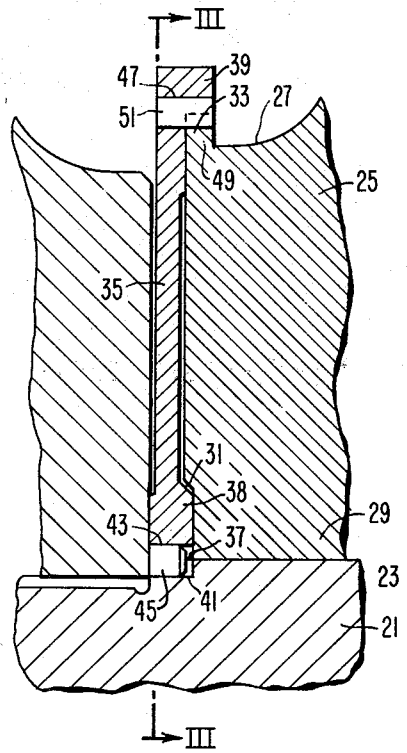
FIG. 2 is a partial sectional view taken on line II—II of FIG. 3.

As shown best in FIG. 2 the hubs 27 of the blade discs 25 have a counterbore 31 and a radially extending rim or flange 33 on one end thereof, the end adjacent the next smaller diameter step. A face disc 35 is disposed adjacent the hub 27. The face disc 35 has a bore 37 which fits a mating step 23, a boss 38 adjacent the bore 37 which fits into the counterbore 31 and a skirt or lip 39 which fits over the flange 33. The shaft 21 and bore 37 of the face disc 37 each have aligned grooves 41 and 43, respectively, which form openings for receiving pins or keys 45 for keying the face disc 37 to the shaft 21. The skirts 39 and flanges 33 each have aligned grooves 47 and 49, respectively, which form openings for receiving pins or keys 51, which key the face disc 35 to the blade disc 25. The face disc 35 hereinbefore described advantageously provides an intermediary member for keying the blade disc 25 to the shaft 21 and eliminating stress concentrations in the bore of the blade disc 25. The groove for the keys in the blade discs are disposed in an area where the tangential stress is significantly lower than that of the bore, thus reducing the possibility of stress cracks originating at the grooves. Preferably the keys have a round cross-section eliminating sharp corners in the keyways to further reduce stress concentrations.

What is claimed is:

1. A rotor for a fluid machine, said rotor comprising:

a shaft having a plurality of circumferential steps which ascend from at least one end thereof;

a plurality of blade discs each having a bore which fits a particular circumferential step;

a plurality of face discs, each face disc being associated with a blade disc and having a bore which fits the same particular circumferential step as the associated blade disc;

a plurality of first keys disposed at the juncture of the circumferential steps and the bore of the face discs, the circumferential steps and face disc bores having aligned grooves forming an opening for receiving the first keys; and a plurality of second keys disposed to extend between the blade discs and the associated face dics, the second keys being displaced radially outwardly from the bore of the discs to a location in the discs where the stresses are lower, the discs having grooves in this location which form openings for receiving the second keys to prevent relative rotation between the blade disc and shaft.

2. A rotor as set forth in claim 1, wherein the blade discs have a counterbore and the face discs have a boss which fit into the counterbore.

3. A rotor as set forth in claim 2, wherein the blade discs have a radially extending rim and the face discs have skirts that extend over the rim.

4. A rotor as set forth in claim 3, wherein the grooves displaced radially outwardly from the bore of the discs are in the rim and skirt and register to form the openings that receive the second keys.

5. A rotor as set forth in claim 2, wherein the face discs are sandwiched between blade discs and are captured therebetween.

* * * * *